United States Patent [19]

Finzi

[11] 4,357,786

[45] Nov. 9, 1982

[54] STEEL TOWER FOR SUPPORTING HIGH- AND VERY HIGH-TENSION LINES IN ELECTRIC NETWORKS

[75] Inventor: Massimo Finzi, Milan, Italy

[73] Assignee: S.A.E. Societa Anonima Elettrificazione S.p.A., Milan, Italy

[21] Appl. No.: 155,346

[22] Filed: Jun. 2, 1980

[30] Foreign Application Priority Data

Jun. 6, 1979 [IT] Italy ..... 23317 A/79

[51] Int. Cl.[3] ..... E04H 12/10

[52] U.S. Cl. ..... 52/649; 52/40; 52/655

[58] Field of Search ..... 52/649, 655, 40; 174/45 R

[56] References Cited

U.S. PATENT DOCUMENTS 814,339 3/1906 Westinghouse ..... 52/40 X 920,157 5/1909 Kreer ..... 52/40

FOREIGN PATENT DOCUMENTS 240386 8/1962 Australia ..... 52/655

862775 12/1940 France ..... 174/45

*Primary Examiner*—Alfred C. Perham

*Attorney, Agent, or Firm*—Seidel, Gonda, Goldhammer & Panitch

[57] ABSTRACT

A self-supporting steel tower for power supply lines at a voltage from 230 to 1000 KV is substantially a tri-dimensional truss structure having a trunk-of-pyramid shape with a triangular cross-section, in particular in the form of an isosceles right triangle. The tower side corresponding to the hypotenuse of the triangle is directed vertically and the other two sides corresponding to the cathetuses are slightly sloping, whereby the tower is tapered upward.

5 Claims, 5 Drawing Figures

Loads in Kg.
Lengths in m.

STEEL TOWER FOR SUPPORTING HIGH- AND VERY HIGH-TENSION LINES IN ELECTRIC NETWORKS

BACKGROUND OF THE INVENTION

The present invention relates to an improved steel tower for supporting high- and very high-tension lines in electric networks, in particular a novel structure as to the cross-section shape, especially for self-supporting towers with the wires arranged side by side or to form a triangle.

It is known that the steel towers of this type for the power supply at a voltage in the range from 230 KV to 1000 KV are formed as a truss structure with steel trussing members mutually joined by bolts. These structures are conventionally and typically in the form of a pyramid with a square or rectangular cross-section, in order to properly utilize the hot-rolled angle irons, commonly used for the bars or trussing members forming the truss structures, which are formed with side flanges bent at right angles.

It is also known that only exceptionally self-supporting steel towers have been made with their cross-section shaped as an equilateral triangle, thereby again with a pyramidal configuration, the pyramid in this case being traingular and not quadrangular. Of course such structures have been assembled by means of welded junctions or by using special section irons with flanges at 60°, whereby the advantages obtained in saving the number of trussing members and as to the foundation works are lower than the considerable outlay due to the utilization of non-standard sections. Therefore this particular configuration has been adopted only for steel towers to be installed in certain positions of the supply network which are subject to lower stresses.

SUMMARY OF THE INVENTION

It is therefore an object of the present invention to provide a tower structure for supporting high- and very high-tension electric lines, which comprises a truss structure tapered upwards with a triangular cross-section and characterized by the fact that the cross-section is an isosceles right triangle, the side of the tower corresponding to the hypotenuse being directed vertically, whereby the upwardly tapering is provided by a slope of the other two sides corresponding to the two cathetuses which are equal to each other and at an angle of 45° with respect to the said hypothenuse.

With a structure of this type, which may be identified as a "truncated obelisk", the upright side is designed to take up the vertical and transverse loads, and the two sloping sides have a stiffening function and co-operate to take up the longitudinal and torsion load.

As a consequence the stresses are distributed in a more rational way and the trusses may be designed more easily from a static point of view. Additionally, when the main load actions are concentrated on a single side, it is possible to use more properly those steels having a high limit of elasticity (i.e. with a yield point $\geqq 45$ kg/mm$^2$). Thus the introduction of unnecessary stiffening bars is avoided, which on the contrary are required in the conventional steel towers in order to limit the deflection of the main trussing members. Now it will be possible, according to the invention, to use steel materials with a higher elastic limit (yield point $\geqq 45$ kg/mm$^2$) and possibly a cold-rolled steel, even with a lower quantity of stiffening bars.

The steel towers according to the present invention are of the self-supporting type with the wires arranged side by side or to form a triangle for lines of supply networks at a voltage from 230 to 1000 KV.

BRIEF DESCRIPTION OF THE DRAWINGS

These and further objects, features and advantages of the steel tower of the invention will be apparent from the following detailed description of one embodiment thereof with reference to the attached drawings, in which.

DETAILED DESCRIPTION OF THE PREFERRED EMBODIMENT

Figure 1:
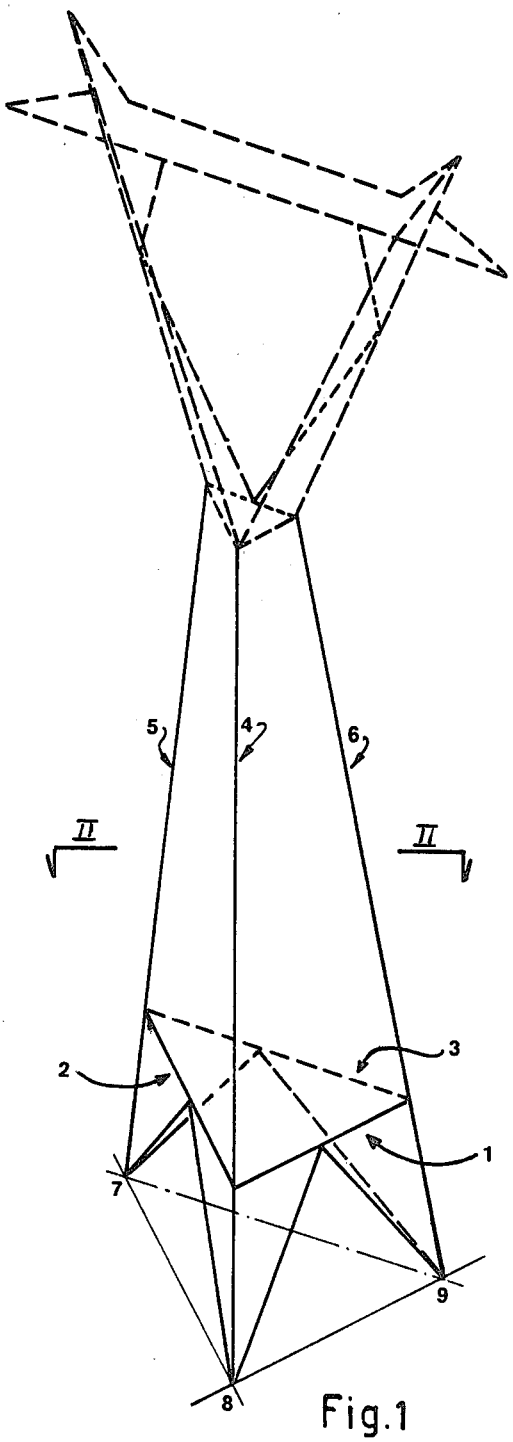
FIG. 1 is a perspective view of a self-supporting steel tower according to the present invention.

Referring now to the drawings, a steel tower for supporting a high- and very-high tension line according to the invention is substantially comprised of an upwardly tapered truss structure with a triangular cross-section, wherein whichever cross-section taken along the length of the tower is shaped as an isosceles right triangle. The same reference numbers 1, 2, 3 which respectively designate two cathetuses and the hypotenuse of such a triangle in FIG. 2 are also an indication of the corresponding tower sides in the representation of FIG. 1.

The side corresponding to the hypotenuse 3 is vertical and has the function of supporting the line load, since all the stresses are concentrated thereon. The other two sides, which are sloping with respect to a vertical plane, each at an angle of 45° with the tower side 3, have a stiffening function while co-operating to take up the longitudinal and torsion loads.

Figure 2:
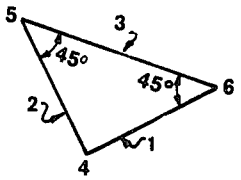
FIG. 2 is a cross-section view taken along line II—II of FIG. 1.

Each tower side, as better shown by FIG. 1, is comprised of a known truss structure between a pair of lateral uprights, respectively 4, 6 for the side 1, 4 and 5 for the side 2 and 5, 6 for the side 3. Each upright has at its lower end one supporting leg, respectively 7, 8 and 9, buried in a proper foundation, such as of concrete.

The truss structure will be preferably formed with sections made of high elastic limit steel having a yield point of more than 45 kg/mm$^2$.

It should be appreciated which are the advantages which may be achieved from an economic point of view, with the self-supporting towers according to the invention, both as to the material and the labor required by the tower foundations, which are three instead of four, and due to the lower number of trussing members and bars forming the truss structure without the above-mentioned inconveniences and limitations involved with the triangular cross-section towers hitherto (very seldom) adopted, having a pyramidal configuration.

Figures 3, 3A, 3B:
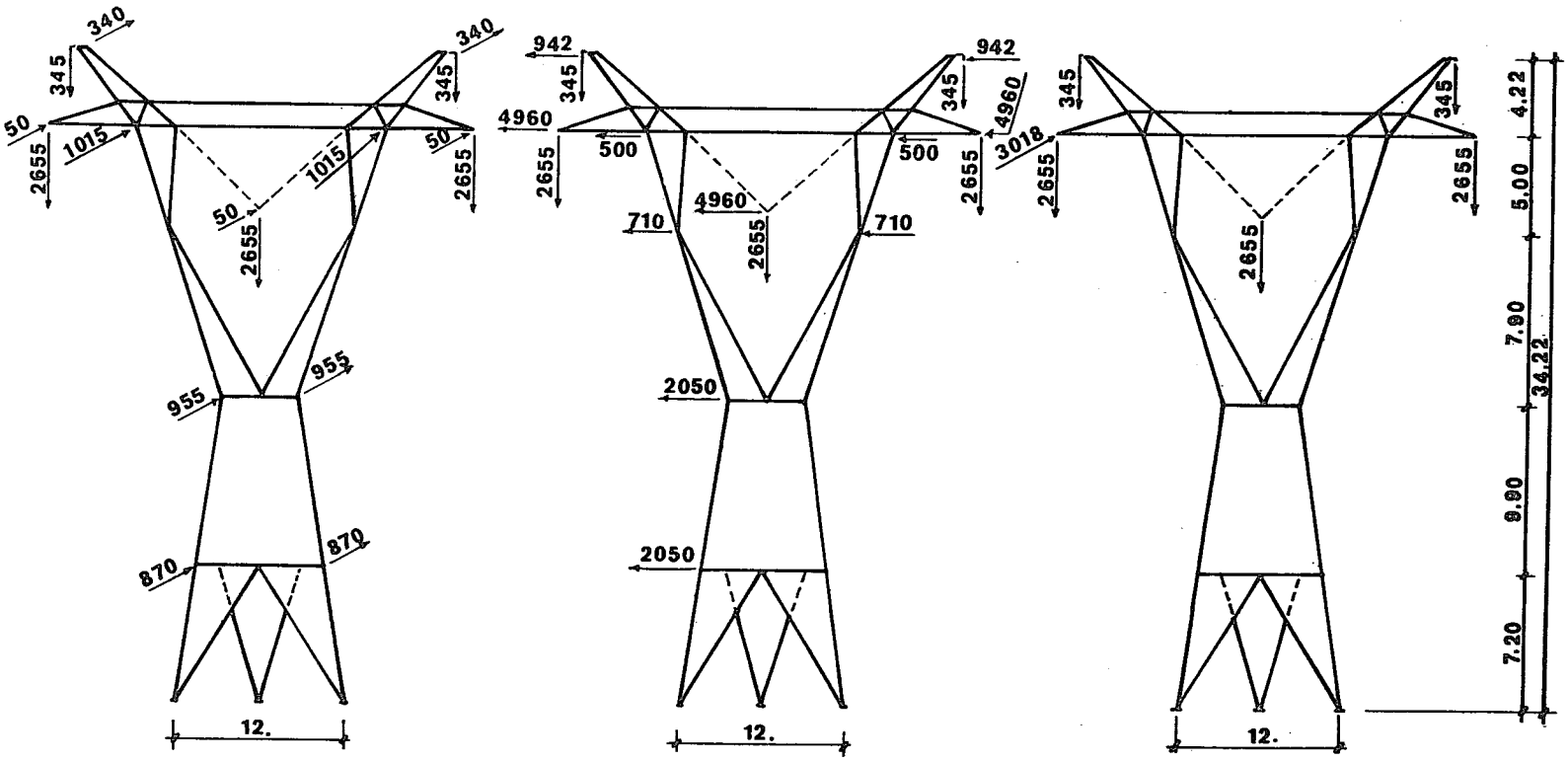
FIGS. 3, 3*a*, 3*b* are three diagrammatic representations of a single steel tower according to the invention, each relating to a particular test condition such as intensity, direction and point of application of a different system of forces as explained in the example.

As a proof of the statements above, the following example is now given with reference to the FIGS. 3, 3*a*, 3*b*.

A self-supporting steel tower according to the features herein claimed and being the object of the present invention has been manufactured, also following the specifications required by the so-called "Plan of Salto Grande" (Argentina-Uruguay) for a supply high-tension line of 500 KV. A prototype sample tower was tested in May 1979 under certain load conditions required by the above-mentioned specifications. The three heaviest test conditions have been represented in FIGS. 3, 3*a*, 3*b* where the arrows are an indication of the direction and point of application of each force applied and the corresponding numbers give the the intensity in kg of each force applied. The dimensional figures reported on the drawing are indicated in m.

It has been found that, although using much less material both as number of section irons and as total weight of metal, and also less work time, the tested tower has undergone no damage even under the heaviest test conditions.

Possible additions and/or variations to the above described and illustrated embodiment of the steel tower according to the invention could be performed by those skilled in the art without exceeding the scope of the invention as defined by the appended claims.

What I claim is:

1. A Steel tower for supporting high- and very high-tension lines in electric networks, which comprises an upwardly tapered truss structure with a triangular cross-section, wherein such a cross-section has the shape of an isosceles right triangle, the tower side corresponding to the hypotenuse being directed vertically, whereby the upward tapering is provided by a slope of the other two sides corresponding to the two cathetuses which are equal to each other and at an angle of 45° with respect to the said hypotenuse.

2. A supporting steel tower according to claim 1, wherein each tower side comprises a planar truss structure between two lateral uprights.

3. A supporting steel tower according to claim 2, wherein the three uprights and the trussing members are section irons made of steel having a high limit of elasticity.

4. A supporting steel tower according to claim 3, wherein said section irons are made of steel having a yield point $\geqq 45$ kg/mm$^2$.

5. A supporting steel tower according to claim 3, wherein said section irons are made of cold-rolled steel.

* * * * *